US005441454A

United States Patent [19]

Race

[11] Patent Number: 5,441,454

[45] Date of Patent: Aug. 15, 1995

[54] WATER TOTTER

[75] Inventor: Elizabeth C. Race, 17 Fenner St., Cazenovia, N.Y. 13035

[73] Assignee: Elizabeth C. Race, Cazenovia, N.Y.

[21] Appl. No.: 286,925

[22] Filed: Aug. 8, 1994

[51] Int. Cl.[6] ..... A63G 11/00

[52] U.S. Cl. ..... 472/129; 472/106; 114/61; 114/363; 440/15; 440/21

[58] Field of Search ..... 472/129, 106, 108, 110, 472/112, 113; 114/363, 61, 191, 194; 440/13–15, 21, 22

[56] References Cited

U.S. PATENT DOCUMENTS

| | | | |
|---|---|---|---|
| D. 189,670 | 1/1961 | Williams et al. . | |
| D. 194,111 | 11/1962 | Tosti . | |
| D. 216,404 | 12/1969 | Froehlich . | |
| D. 229,206 | 11/1973 | Diemond et al. . | |
| D. 264,987 | 6/1982 | Wise . | |
| 273,530 | 5/1883 | Hill . | |
| D. 331, 430 | 12/1992 | Nolan . | |
| 982,314 | 1/1911 | Tothill . | |
| 1,589,443 | 6/1926 | Taylor . | |
| 1,695,737 | 12/1928 | Molsdale . | |
| 3,041,070 | 6/1962 | Kerstein . | |
| 3,110,047 | 11/1963 | Bringman . | |
| 3,620,529 | 11/1971 | Newman | 472/106 |
| 3,666,265 | 5/1972 | Ammerman et al. | 472/106 |
| 3,833,956 | 9/1974 | Meehan | 440/14 X |
| 4,003,571 | 1/1977 | Nipper | 472/114 |
| 4,101,996 | 7/1978 | Mikulecky . | |
| 4,214,547 | 7/1980 | Hetland | 440/22 X |
| 4,288,071 | 9/1981 | Glickson | 472/106 X |
| 4,700,648 | 10/1987 | Trefethern et al. | 414/363 X |
| 4,968,273 | 11/1990 | Momot | 440/14 |
| 5,004,296 | 4/1991 | Ziegenfuss, Jr. . | |
| 5,217,398 | 6/1993 | Meron et al. | 440/21 X |
| 5,308,268 | 5/1994 | Schmid | 440/21 X |
| 5,334,066 | 8/1994 | Gerard | 472/129 X |

FOREIGN PATENT DOCUMENTS

| | | | |
|---|---|---|---|
| 1066137 | 6/1954 | France . | |
| 1055771 | 1/1967 | United Kingdom . | |
| 1583120 | 8/1990 | U.S.S.R. | 472/128 |

OTHER PUBLICATIONS

WO 92009348, Jun. 1992, Water Sports Device.

*Primary Examiner*—Carl D. Friedman
*Assistant Examiner*—Beth A. Aubrey
*Attorney, Agent, or Firm*—Hill, Steadman & Simpson

[57] ABSTRACT

A water teeter-totter is provided having a seating member for two or more persons. The seating member is pivotally mounted to a floating, buoyant support member, such as one defined by a pair of pontoons. The seating member is rockable relative to the floating support member by seated persons in a seesaw motion. In an embodiment, a propeller or other mover is operably connected to the seating body and propels the water totter device through the water upon rocking of the seating member relative to the floating support member(s).

20 Claims, 4 Drawing Sheets

WATER TOTTER

BACKGROUND OF THE INVENTION

The present invention generally relates to floating recreation devices. More particularly, the present invention relates to a floating water recreation device having a rocking motion.

Floating water amusement devices are known in the prior art for supporting one or more persons on water in a pool, a lake, or the ocean. For instance, air mattresses or floating chairs are often used by swimmers or sunbathers. Other floating structures are known for providing more active entertainment.

Prior art water recreation devices are disclosed in U.S. Pat. Nos. 3,110,047, 3,629,529 and 3,666,265. Rocking amusement devices are also known for use on land. One rocking toy of this type is called the Little Tikes® Teeder-Rock TM marketed by Rotadyne, Inc., as disclosed in Industry News, September, 1965. The Little Tikes® device comprises a one-piece molded body having a curved bottom and two interiorly facing seats.

Some prior art rockable water toys include an inflatable component which requires proper inflation and maintenance for safe use. One shortcoming of these devices is that the inflatable components can be punctured. Furthermore, prior art rockable water toys can tend to tip over sideways or be unstable in the water. In order to increase the enjoyment of a rockable amusement device, a more stable floating device is desirable.

Some prior art water amusement devices include a rigid frame with multiple struts and support members, such as those disclosed in U.S. Pat. Nos. 3,629,529, and 3,666,265. These devices may be dangerous during water play, as they can entangle with human limbs and cause injury.

Accordingly, a need exists for an improved water recreation device which is stable and safe. Furthermore, a need exists for an improved rocking water recreation device which has few components and can be easily manufactured and maintained.

SUMMARY OF THE INVENTION

The present invention provides a water recreation device that is fun, safe, and versatile. To this end, in an embodiment, a water recreation device is provided which has a seating body member defining seats. Also provided is a floating platform member defined which is by at least one buoyant support member. The floating platform member is adapted to mountably secure the seating body member. Furthermore, means are provided for pivotally mounting the seating body member to the floating platform member. The seating body member is rockable relative to the floating platform member in a seesaw motion.

In an embodiment, the seating body member is buoyant.

In an embodiment, the seating body member has an upwardly curved, generally U-shaped configuration defining two raised opposed ends. Each end has at least one seat such that the seats are oppositely disposed between the ends. The seats can be oriented to face each other or so that they face in a common direction.

In an embodiment, the floating platform member includes a pair of spaced apart elongated pontoon support members. The seating body member is pivotally connected between the pontoon members.

In an embodiment, the seating body member including persons seated therein has an approximate center of mass. The seating body member is pivotally mounted along a pivot axis disposed below the approximate center of mass.

In another embodiment, the seating body member including persons seated therein has an approximate center of mass. The seating body member is pivotally mounted along a pivot axis extending through the approximate center of mass.

In yet another embodiment, the seating body member including persons seated therein has an approximate center of mass. The seating body member is pivotally mounted along a pivot axis disposed above the approximate center of mass.

In an embodiment, the device includes a propeller effective to move the device through the water. The propeller is operably connected to the seating body member such that seesaw movement of the seating body member relative to the floating platform causes the propeller to move the device through the water.

In an embodiment, the propeller includes a pair of flippers.

In an embodiment, a water recreation device is provided which has a buoyant support. A body having two ends is pivotally mounted at a pivot point to the buoyant support. At least one seat is defined within the body at each end. The body is rockable relative to the buoyant support by persons seated on the seats in a reciprocating motion.

In an embodiment, the buoyant support is defined by at least two spaced apart, buoyant pontoons. The body is pivotally mounted to the pontoons at a point on the body between the seats.

In an embodiment, the pivot point is adjustable along an axis extending longitudinally between the two ends. In another embodiment, the pivot point is vertically adjustable in a direction along a heightwise axis.

In an embodiment, a water teeter-totter is provided having a buoyant body. The buoyant body has an upwardly curved bottom with two raised opposed ends, such that each end has an inwardly facing seat. Two buoyant pontoons are provided such that each pontoon is pivotally connected to the body at a pivot point between the seats. The body can be rocked by seated persons in a seesaw motion relative to the pontoons.

In an embodiment, the teeter-totter includes seat belts for retaining persons in the seats.

In an embodiment, the seats include arm rests and seat backs.

In an embodiment, the teeter-totter includes a drink holder in at least one of the arm rests.

In an embodiment, the teeter-totter includes a waterproof compartment in at least one of the arm rests.

It is, therefore, an advantage of the present invention is to provide a water teeter-totter which is fun.

Another advantage of the present invention is to provide a water-teeter totter which is safe.

Yet another advantage of the present invention is to provide a water-teeter totter which can be enjoyed by persons of different sizes.

Still another advantage of the present invention is to provide a water teeter-totter which is easy to assemble and maintain.

An additional advantage of the present invention is to provide a water teeter-totter which propels itself through the water.

A still further advantage of the present invention is to provide a water teeter-totter which is stable.

A further advantage of the present invention is to provide a water teeter-totter which is simple to manufacture.

Additional features and advantages of the present invention are described in, and will be apparent from, the detailed description of the presently preferred embodiments and from the drawings.

DETAILED DESCRIPTION OF THE PREFERRED EMBODIMENTS

Figure 1:
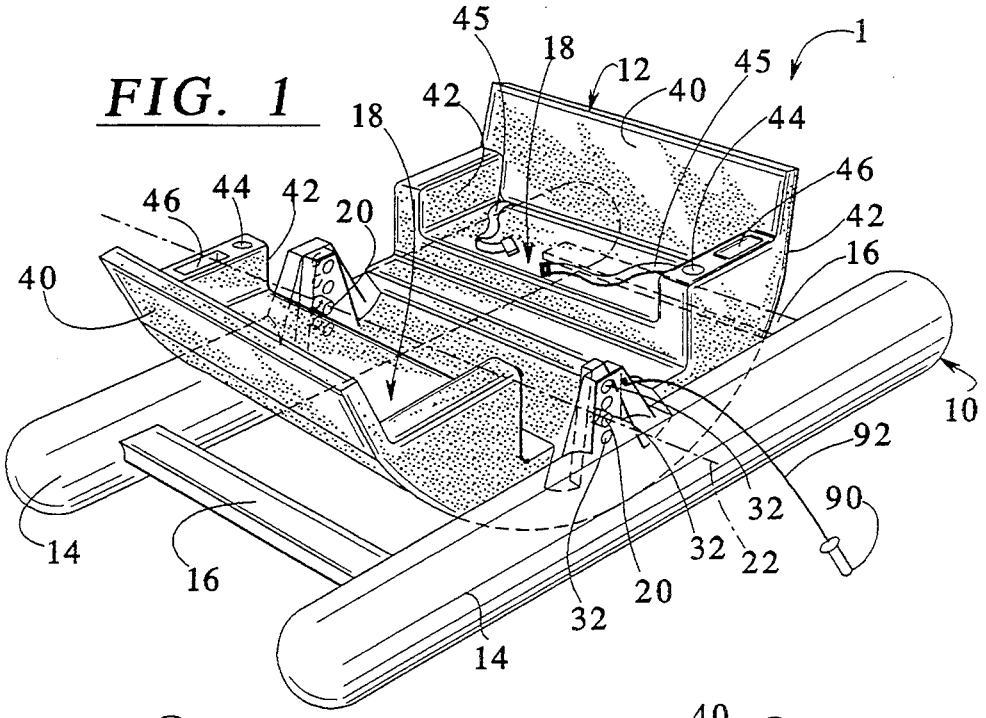
FIG. 1 is a perspective view of the water teetertotter in accordance with this invention.

In accordance with the invention described with reference to the accompanying figures wherein like numerals designate like parts, a water teeter-totter device 1 is provided. The device 1 is configured to float on water. As illustrated in FIG. 1, the device 1 has a buoyant support body 10 defining a floating platform to which a seating body 12 is pivotally connected.

Figure 2:
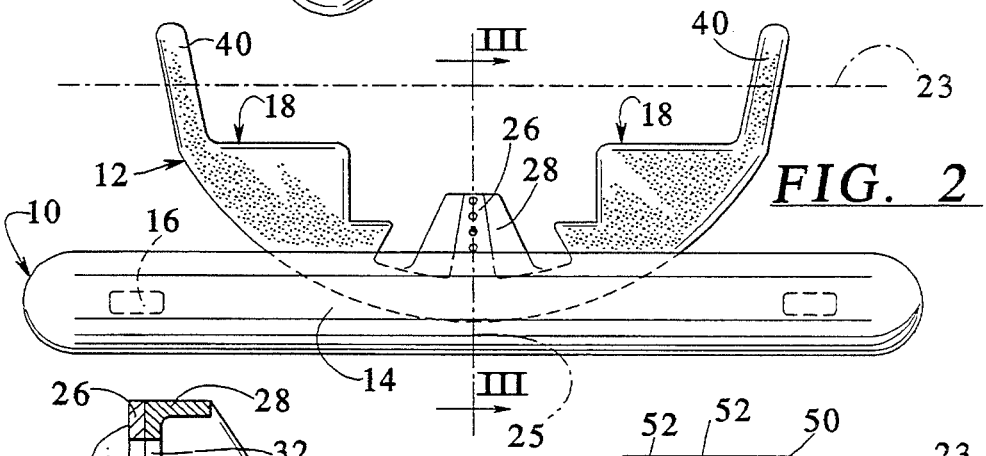
FIG. 2 is an elevated side view of the water teeter-totter shown in FIG. 1.
Figure 3:
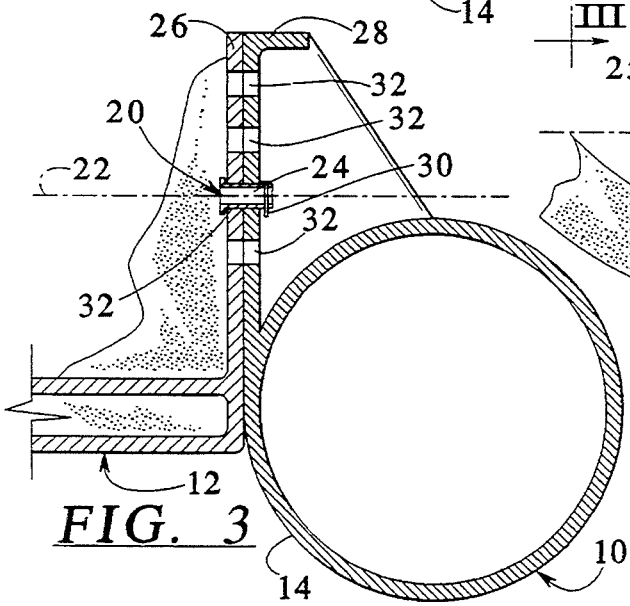
FIG. 3 is an enlarged fragmentary cross sectional view of the water teeter-totter taken generally along view line III—III in FIG. 2.

In the embodiment illustrated in FIGS. 1–3, the support body 10 includes two buoyant pontoons 14. The pontoons 14 are lighter than water, so that they float. The pontoons 14 can be constructed of a foam material, plastic, fiberglass, or some other material which is waterproof and preferably corrosion resistant.

The pontoons 14 can be connected by crossmembers 16. This construction causes the pontoons 14 to float on water as a single unit. However, in an embodiment, the crossmembers 16 are not provided so that the pontoons 14 can float and pivot independently of one another.

The seating body 12 has at least two seats 18 configured for seating persons (not shown). Between the seats 18, the seating body 12 is pivotally connected to the support body 10 to rotate in relation thereto about a pivot point 20. As illustrated, two pivot points 20 are provided so that the seating body 12 can rotate relative to the support body 10 about a pivot axis 22. The seating body 12 is positioned between the pontoons 14 so that the pontoons 14 provide a stabilizing effect on the water.

The pivot points 20 are preferably positioned approximately midway between the seats 18. Such a configuration results in better rocking performance of the seating body 12 because the total weight of the seating body 12 with seated persons is distributed roughly evenly on either side of the pivot axis 22.

Also illustrated in FIG. 2 is longitudinal axis 25 which extends along the seating body 12 generally along a direction from seat to seat 18. Furthermore, FIG. 2 illustrates a vertical axis 25 which generally extends along a heightwise direction.

The pivotal connection at each pivot point can be a pin 24, as illustrated in FIG. 3. The pin 24 extends through upward extension 26 of the seating body 12 and through adjacent upward projections 28 of the pontoons 14. The pin 24 is secured in position by a cotter pin 30. The pivot points 20 can be vertically adjustable along the vertical axis 25 (FIG. 2) by selective placement of the pin 24 in one of multiple holes 32 provided in the extensions 24 or projections 28. Alternatively, some other pivotal connection could be used such as a hinge or even a rolling contact of the seating body 12 along a track (not shown) disposed in the support body 10.

In the embodiment of FIG. 1, a second pin 90 can be inserted in one of the holes 32 for providing stability to the device 1 during loading and unloading of passengers. The second pin prevents the seating body 12 from rocking relative to the support body 10. The second pin 90 is pulled out to allow rocking when the occupants are aboard. A cord, rope or cable 92 can be used to secure the second pin 90 to the support body 10 or the seating body 12 so that it cannot be easily lost.

The seating body 12 can be lighter than water. Preferably, as shown in FIGS. 1–3, the seating body 12 has an upwardly curved, U-shaped bottom so that the seating body can floatably rock with little water resistance. The seats 18 are formed in opposite ends of the device 1, and are positioned to be held afloat above the water. Like the support body 10, the seating body can be constructed of foam, plastic, fiberglass, or some other corrosion-resistant material.

The seats 18 can include seat backs 40 and armrests 42. A drink holder 44 can be recessed in the armrests 42. Also, a waterproof compartment 46 can be placed in the armrests 42 for dry storage of wallets, watches, keys or other personal items. Furthermore, seatbelts 45 can be provided to safely retain a person in a seat 18.

Figure 8:
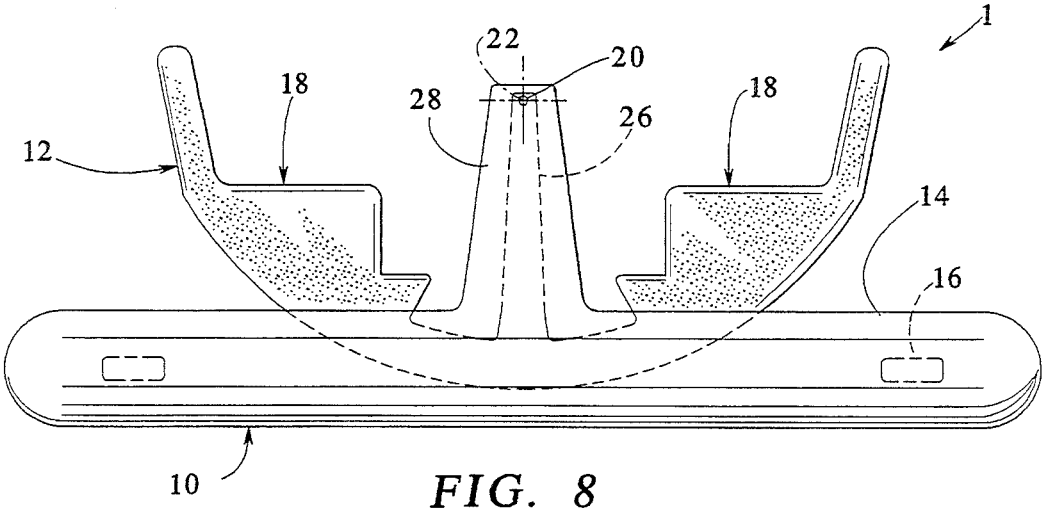
FIG. 8 is an elevated side view of an alternative embodiment of the water teeter-totter of the present invention.

Seated persons can rock the device 1 by shifting their weight forward and backward, resulting in a fun teeter-totter action. Various teetering actions can be achieved through different vertical positions of the pivot points 20 relative to the seating body 12. More particularly, action can vary based on the vertical positioning of the pivot points 20 relative to the center of mass of the seating body 12 with persons seated thereon. For instance, positioning the pivot points 20 low on the seating body 12 would result in a deeper, wilder rocking action. On the other hand, high positioning of the pivot points 20 relative to the seating body 12 would result in a smoother, swinglike motion (FIG. 8).

The water recreation device 1 can be configured so the support body 10 provides the entire buoyant support for the device 1 and persons seated thereon. In such an embodiment, the seating body 12 could be nonbuoyant. On the other hand, the water recreation device 1 could be configured so that a some or all of the buoyant support is provided by the seating body 12. In such an embodiment, the support body 10 still provides buoyant lateral stability to prevent sideways tipping.

Figure 4:
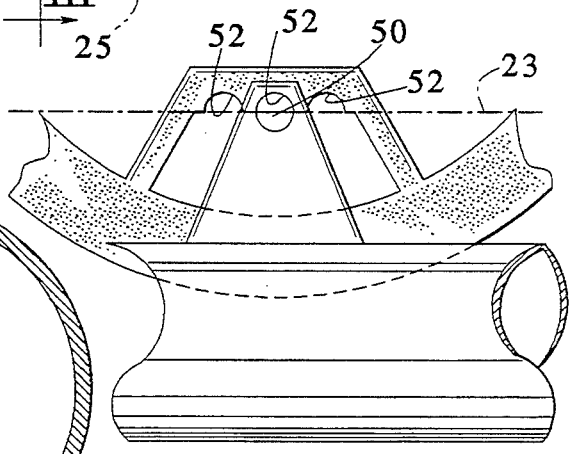
FIG. 4 is an enlarged fragmentary side view of another embodiment of the pivotal connection of the water teeter-totter.

It is desirable that the seating body 12, including the persons seated thereon, has an even weight distribution on either side of the axis 22. However, it is unlikely that persons seated opposite each other will be of equal weight. Therefore, in an embodiment, the pivot points 20 are horizontally adjustable along the longitudinal axis 23. Such an embodiment is illustrated in FIG. 4. A rigid tube 50 extends between the pontoons 14, and the seating body 12 has a series of spaced notches 52 configured to rest atop of the tube 50 to form the pivotal connection. The teeter totter 1 is adjustable by lifting the seating body 12 and placing a selected notch 52 on the tube 50. Thereby, the pivot points 20 can be moved closer to a seat for use by a heavier person so that the weight is distributed more evenly, resulting in a more even rocking effect.

The support body 10 could alternatively be another floating platform structure. For instance, instead of pontoons, multiple buoyant bodies shaped as spheres, cylinders, or other shapes could be used instead of the pontoons 14. Also, the support body 10 could be a unitary structure, such as a large square having the seating body 10 pivotally mounted on top or within a center cutout.

Figure 5:
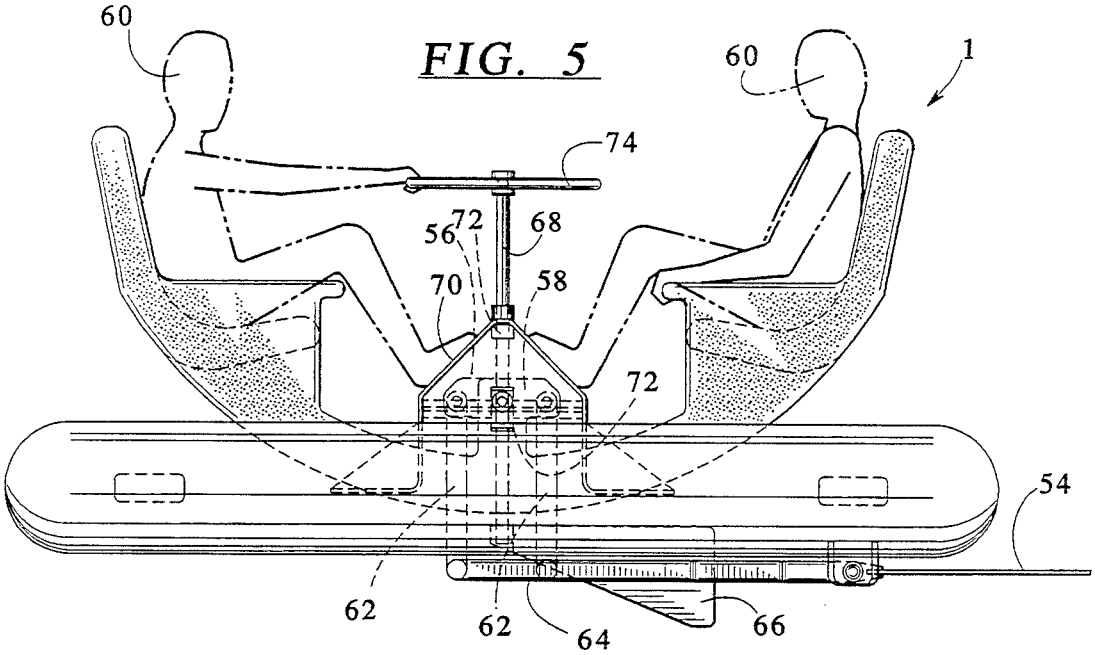
FIG. 5 is an elevated side view of an embodiment of the water teeter-totter which has a propelling means.
Figure 6:
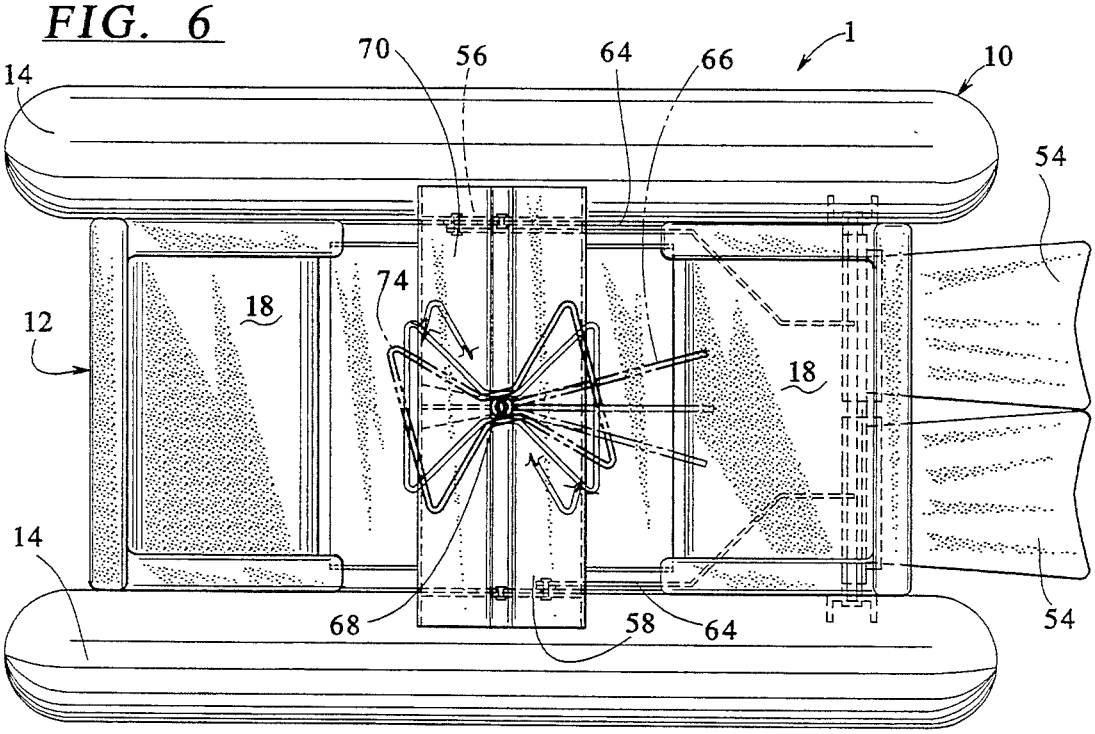
FIG. 6 is a top plan view of the water teeter-totter having a propelling means showing a steering action of the rudder.
Figure 7:
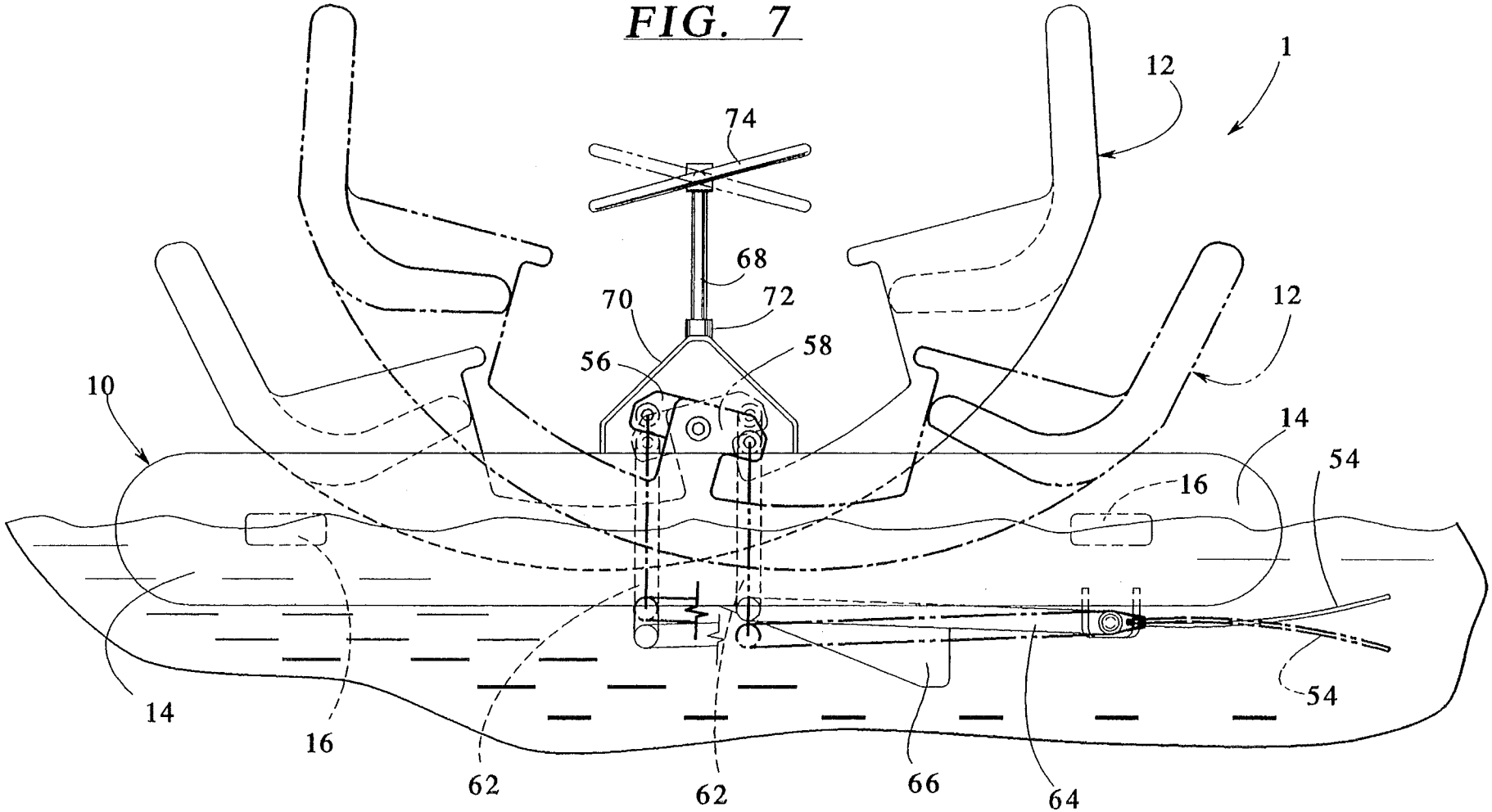
FIG. 7 is an elevated side view of the water teeter-totter having a propelling means showing the actuation by rocking.

In an embodiment of the invention, a propelling means is operably connected to the seating body 12. As illustrated in FIGS. 5–7, a pair of flippers 56 are pivotally mounted between the pontoons 14. In this embodiment, two actuating members 56 and 58 extend upwardly from the bottom of the seating body 12. The actuating members 56 and 58 are caused to reciprocate with the seating body 12 upon rocking by occupants 60.

The actuating members 56 and 58 are each pivotally connected to the upper end of a vertical link 62. The actuating members 56 and 58 are offset opposite each other so that as one rocks up, the other is rocking downward, and vice-versa. Each vertical link 62 has a bottom end which is pivotally connected to an associated rod 64 which extends from each respective flipper 54. A rocking of the seating body 12 results in a reciprocation of the vertical links 62, and thus a flipping motion of the flippers 54 to propel the device 1 through the water.

In conjunction with the propelling means, a steering rudder 66 is provided. The steering rudder 66 is preferably operable by an occupant 60 on either side of the seating body 12. The steering rudder 66 is secured to a central shaft 68 which extends upwardly through a crossbeam 70 which is secured between the pontoons 14. Therefore, the central shaft 68 remains vertically fixed relative to the pontoons 14, however, the shaft 68 is rotatable within bearings 72. Furthermore, the crossbeam 70 is preferably configured to act as a foot rest.

A steering handle 74 is pivotally mounted at the top of the shaft 68. The steering handle 74 is configured to be gripped by an occupant 60 on either side. Because the occupants 60 rock in the seating body 12 relative to the shaft 68, the steering handle 74 is pivotable so that it moves with the hands of the rocking occupants 60.

In FIG. 8, an embodiment is illustrated which has a pivot point 20 located relatively high. In such an embodiment, the pivot axis 22 can be above the center of mass of the seating body including persons seated thereon.

Figure 9:
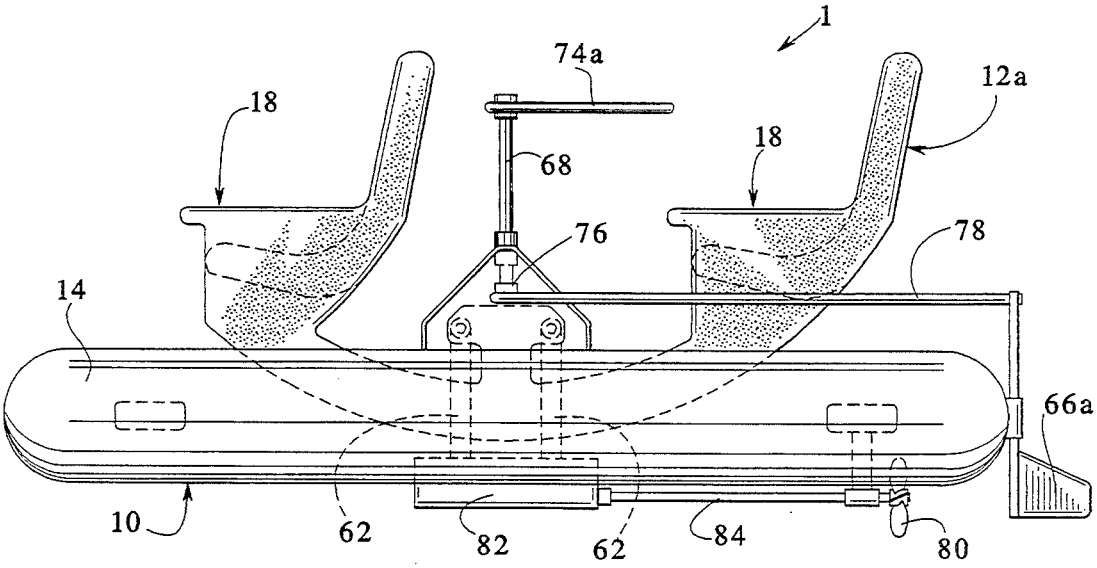
FIG. 9 is an elevated side view of an alternative embodiment of the water teeter-totter of the present invention.

FIG. 9 illustrates an alternative embodiment wherein a seating body **12*a* has seats 18 which are oriented to face in a common direction. Such a configuration is particularly desirable for use in conjunction with a propelling means so that the persons seated in the teeter-totter device 1** are facing in the direction of travel.

Also illustrated in FIG. 9 is a steering means which includes at least one rudder **66*a* which hinges on the rear of a pontoon 14. A T-bar 76 is attached to the shaft 68 by a linkage 78 to operate the rudder 66*a*. A steering handle 74*a* is pivotally mounted on the shaft 68 for operation by a person in the facing seat 18**.

Furthermore, FIG. 9 illustrates a screw-type rotational propeller 80. As described above, rocking motion of the seating body **12*a* causes reciprocating motion of the vertical links 62. A linkage or gearbox 82 converts the reciprocating motion of the vertical links 62 into rotational motion of a driveshaft 84 which is disposed through a bearing 86. The propeller 80 is positioned on an end of the driveshaft 84**, and is driven thereby to propel the water-totter through water.

It should be understood that various changes and modifications to the presently preferred embodiments described herein will be apparent to those skilled in the art. For example, the seats can either face each other or face in the a common direction. Also, the components can be constructed of foam instead of hollow fiberglass or plastic. Furthermore, the propeller or propulsion device can be flippers, a paddlewheel, or a screw-type rotating propeller. All such obvious changes and modifications may be made without departing from the spirit and scope of the present invention and without diminishing its attendant advantages. It is, therefore, intended that such changes and modifications be covered by the appended claims.

I claim:

1. A water recreation device comprising: a seating body member defining seats; a floating platform member defined by at least one buoyant support member and adapted to mountably secure the seating body member; and means for pivotally mounting the seating body member to the floating platform member, whereby the seating body member is rockable with respect to the floating platformmember in a seesaw motion.

2. A device according to claim 1, wherein the seating body member is buoyant.

3. A device according to claim 1, wherein the seating body member comprises a body having a generally U-shaped configuration with an upwardly curving bottom and two opposing raised ends, each end having at least one seat defined therein, said seats being oriented so that in said seating body member they are facing in the same direction or are oppositely facing.

4. A device according to claim 1, wherein the floating platform member includes a pair of spaced apart elongated pontoon support members, and the seating body member is pivotally connected between the pontoon members.

5. A device according to claim 1, wherein the seating body member including persons seated therein has an approximate center of mass, and the seating body member is pivotally mounted along a pivot axis disposed below the approximate center of mass.

6. A device according to claim 1, wherein the seating body member including persons seated therein has an approximate center of mass, and the seating body member is pivotally mounted along a pivot axis extending through the approximate center of mass.

7. A device according to claim 1, wherein the seating body member including persons seated thereon has an approximate center of mass, and the seating body member is pivotally mounted along a pivot axis disposed above the approximate center of mass.

8. A device according to claim 1, further comprising a propeller effective to move the device through the water, said propeller being operably connected to the seating body member such that seesaw movement of the seating body member relative to the floating platform causes the propeller to move the device through the water.

9. A water recreation device comprising: a buoyant support; a body having two ends with at least one seat at each end, the body being pivotally mounted at a pivot point to the buoyant support, whereby the body is rockable relative to the buoyant support by persons seated on the seats.

10. A device according to claim 9, wherein said buoyant support comprises at least two buoyant pontoons, the body being pivotally mounted to the pontoons at a point on the body between the seats.

11. A device according to claim 9, wherein the pivot point is adjustable along a longitudinal axis of the body defined between the two ends.

12. A device according to claim 9, further comprising a propeller.

13. A device according to claim 12, wherein the propeller is operably driven by the reciprocating motion of the body relative to the buoyant support.

14. A device according to claim 13, wherein the propeller includes a pair of flippers.

15. A water teeter-totter comprising: a buoyant body having an upwardly curved bottom with two raised opposed ends, each end having an inwardly facing seat; two buoyant pontoons, each pontoon being pivotally connected to the body at a pivot point between the seats, whereby the body can be rocked by seated persons in a seesaw motion relative to the pontoons.

16. A teeter-totter according to claim 15, further comprising seat belts for retaining persons in the seats.

17. A teeter-totter according to claim 15, wherein said seats include arm rests and seat backs.

18. A teeter-totter according to claim 17, further comprising a drink holder in at least one of the arm rests.

19. A teeter-totter according to claim 17, further comprising a waterproof compartment in at least one of the arm rests.

20. A teeter-totter according to claim 15, further comprising a propeller effective to move the teeter-totter across water, the propeller being operably connected to the buoyant body such that said seesaw motion causes the propeller to move the teeter-totter across the water.

* * * * *